United States Patent [19]

Oguri

[11] Patent Number: 4,713,996

[45] Date of Patent: Dec. 22, 1987

[54] AUTOMATIC RHYTHM APPARATUS WITH TONE LEVEL DEPENDENT TIMBRES

[75] Inventor: Shigenori Oguri, Hamamatsu, Japan

[73] Assignee: Nippon Gakki Seizo Kabushiki Kaisha, Hamamatsu, Japan

[21] Appl. No.: 836,840

[22] Filed: Mar. 6, 1986

[30] Foreign Application Priority Data

Mar. 11, 1985 [JP] Japan ..... 60-47667

[51] Int. Cl.[4] ..... G10H 1/08; G10H 1/40; G10H 7/00

[52] U.S. Cl. ..... 84/1.03; 84/1.22; 84/1.27; 84/1.28; 84/DIG. 12

[58] Field of Search ..... 84/1.03, 1.27, DIG. 12, 84/1.19–1.23, 1.28

[56] References Cited

U.S. PATENT DOCUMENTS

| | | | |
|---|---|---|---|
| 4,198,891 | 4/1980 | Weber | 84/1.03 |
| 4,305,319 | 12/1981 | Linn | 84/1.27 X |
| 4,336,736 | 6/1982 | Mishima | 84/1.03 X |
| 4,554,854 | 11/1985 | Kato | 84/1.03 |
| 4,586,416 | 5/1986 | Sano | 84/1.03 |

*Primary Examiner*—S. J. Witkowski
*Attorney, Agent, or Firm*—Spensley Horn Jubas & Lubitz

[57] ABSTRACT

Tones of percussion instruments produce different timbres, i.e. different tone waveshapes, depending on the strength of percussion. An automatic rhythm apparatus includes a rhythm tone generating unit which stores the tone waveshape produced from a hard percussion and also that from a soft percussion performed on a same percussion instrument. A rhythm pattern is constructed by rhythmically aligned tone command signals, for various percussion instruments, designating timings and volumes of tones to be produced. At each tone production, these two kinds of waveshapes are read out by mixing them appropriately. That is, when a loud tone is to be reproduced, its waveshape is read out from the waveshape memory for loud tones, while a soft tone is read out likewise from the waveshape memory for soft tones, and a tone of an intermediate volume therebetween is reproduced by reading out the loud tone and the soft tone at a mixing ratio complying to the desired degree of volume. Percussion tones from a same percussion instrument are thus read out throughout the loud-to-soft range in successive variations in compliance to the actual percussions played on the instrument. Accordingly, the reproduced percussion sound varies not only in tone volume but also in tone color, and thus a rhythm performance rich in natural feeling is realized.

10 Claims, 13 Drawing Figures

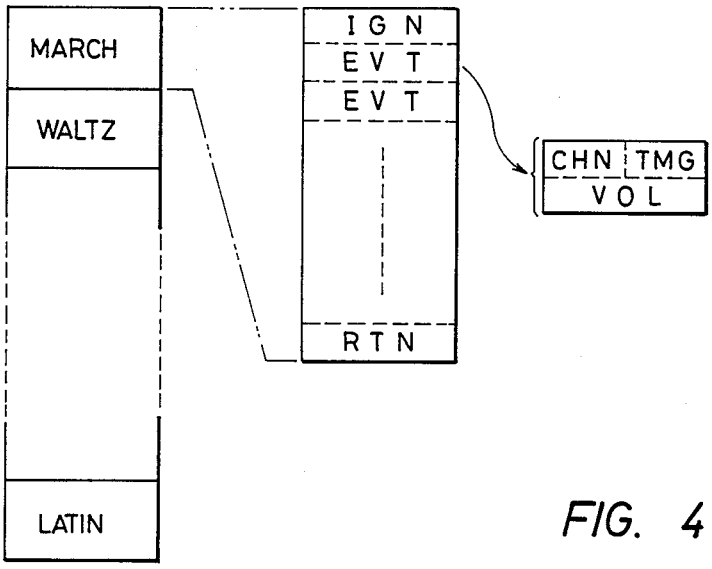
FIG. 4
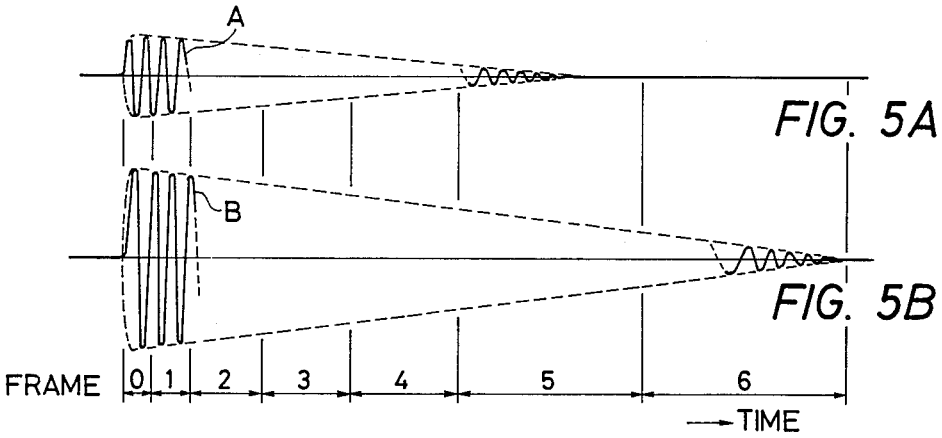
FIG. 5A
FIG. 5B

AUTOMATIC RHYTHM APPARATUS WITH TONE LEVEL DEPENDENT TIMBRES

BACKGROUND OF THE INVENTION (a) Field of the Invention:

The present invention relates to an automatic rhythm apparatus, and more particularly it pertains to an automatic rhythm accompaniment apparatus having an improved tone generating unit which produces rhythm tones with variable timbres of the same instrument according to tone levels.

(b) Description of the Prior Art:

In the conventional automatic rhythm accompaniment apparatuses, there is known the tone generating circuitry which is so arranged that the tone waveshape for a plurality of cycles of a percussion tone produced from each kind of percussion instrument (typically, the whole waveshape of a percussion tone ranging from the attack through to the end of decay) is A/D-converted and the resulting waveshape data is stored in a memory, and that the stored waveshape data is read out from the memory to reproduce the percussion tone.

Also known is the art that an apparatus arranged so that the tone volume (levels) of the reproduced tones are increased at specific beats in order to add an accent to the rhythm tone performance.

According to such prior art arrangements as mentioned above, there has been the problem such that, in case the tone volume (levels) of the reproduced tone is to be controlled for the purpose of, for example, adding an accent to the rhythm, there is not obtained a variation of tone color of the rhythm tone being reproduced, although there may be obtained a variation of the tone volume thereof, and that accordingly the reproduced rhythm tones lack natural feeling. More particularly, in natural percussion instruments, there develops a difference in waveshape between a hard percussion tone (strongly struck tone) and a soft percussion tone (softly struck tone) as will be exemplarily shown in FIGS. 1 and 2 with respect to a "tam-tam" drum, and the tone color is noted to show a variation along with the tone volume. However, in conventional automatic rhythm apparatuses, there has not been obtained such a variation of tone color. It should be noted here that, although the waveshape shown in FIGS. 1 and 2 is produced, actually, in a continuous form throughout the period of time $t_1 \sim t_7$ or $t_1' \sim t_7'$, but the waveshape is illustrated here in divided fragments for the convenience of depiction.

In general, in order to realize a variation of tone color of a percussion tone in compliance to the level of the tone volume or loudness thereof, there may be considered such a technique that a number of different waveshapes corresponding to the various different intensities of percussion per percussion instrument are stored respectively in memory means, and that an optimum waveshape is selected in compliance to the level of the tone volume which is desired to be read out. Such an arrangement of apparatus, however, gives rise to the inconveniences that the capacity of the memory means naturally becomes tremendously large and that, accordingly, the apparatus as a whole unavoidably becomes complicated and costly.

SUMMARY OF THE INVENTION

It is, therefore, a primary object of the present invention to provide an automatic rhythm accompaniment apparatus which eliminates such inconveniences and drawbacks of the rhythm apparatuses of the prior art, which makes it feasible, by a relatively simple arrangement, to generate rhythm tones which are rich in natural feeling such that the tone color of the reproduced rhythm tone varies also in accordance with the variation of the tone volume thereof.

Another object of the present invention is to provide an automatic rhythm performance apparatus of the type mentioned above, which makes it possible to realize a substantial reduction of the storage capacity of the memory storing the data of percussion tones of various kinds of percussion instruments.

Still another object of the present invention is to provide an automatic rhythm apparatus of the type mentioned above, which generates reproduction tones of a good quality.

The above-mentioned objects of the present invention is attained by the provision, in an automatic rhythm apparatus, of a rhythm tone generating unit having a first and a second memory means for a same instrument tone respectively storing two kinds of waveshapes as a first and a second percussion tone waveshape which correspond to the waveshapes for a plurality of cycles of mutually different first and second percussion tones, respectively, obtained by percussing a same percussion instrument with different degrees of hardness (strength); tone generation command means for producing tone command signals designating timings and volumes of instrument tones to constitute a rhythm performance pattern; reading-out means for reading out the stored first and second percussion tone waveshapes from said first and second waveshape memory means at the designated timings, respectively; mixing means for mixing the first and second percussion tone waveshapes as they are read out from said first and second waveshape memory means, respectively; and control means for controlling the ratio with which the first and second percussion tone waveshapes are mixed together in compliance to the tone volume designated by the tone command signal.

According to the arrangement of the automatic rhythm apparatus of the present invention, two kinds of tone waveshapes representing mutually different percussion intensities of a same instrument are mixed together, and this mixing ratio is controlled in accordance with a tone volume command signal, so that there is obtained not only a variation of tone volume (intensity) but also a variation of tone color (variation of tone waveshape). Whereby, there can be obtained rhythm tones rich in natural feeling. Furthermore, for the waveshape memory means, the provision of a memory having a capacity for only two kinds of waveshapes is enough for one instrument. And, the mixing means as well as the control means can be constructed by such well-known parts as a multiplier, an adder and a memory, so that the arrangement of the tone generating unit as a whole does not become so complicated as noted in the prior art such means.

According to another aspect of the present invention, the first and second percussion tone waveshapes are stored in their mutually phase-matched form in the memory means, so that there can be prevented, at the time that these two kinds of waveshapes are mixed together, the development of an abnormal waveshape which is attributable to, for example, a beat phenomenon, and thus a reproduced tone closely approaching the percussion tone peculiar to a natural percussion instrument can be obtained.

According to still another aspect of the present invention, arrangement is provided so that the first waveshape memory means stores the waveshape corresponding to the waveshape for a plurality of cycles of either one of the abovesaid first and second percussion tones, and that the second waveshape memory means stores the waveshape corresponding to the difference in instantaneous amplitude (wave value) of the phase-matched waveshapes for a plurality of cycles of said first and second percussion tones. Whereby, the storing capacity required for the memory means can be all the more reduced, thus making it possible to further simplify the apparatus as a whole and to make same at a further reduced cost.

These and other objects of the present invention as well as the features and the advantages thereof will be apparent from the following detailed description of the preferred embodiments when taken in conjunction with the accompanying drawings.

FIG. 4 is a format diagram of the rhythm pattern data.

FIGS. 5A and 5B are waveshape diagrams showing examples of framing of the original waveshapes in their phase-matching processing.

Figure 6A:
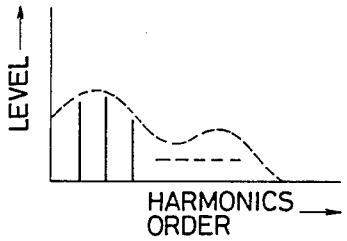
Figure 6B:
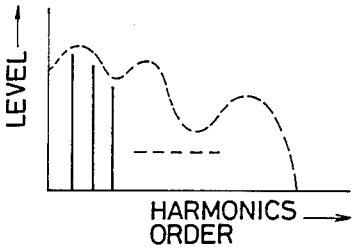
Figure 6C:
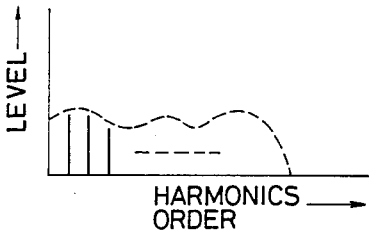

FIGS. 6A~6C are graphs each showing a spectrum for one frame.

Figure 7:
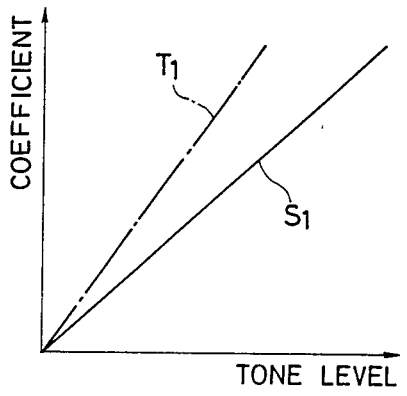
Figure 8:
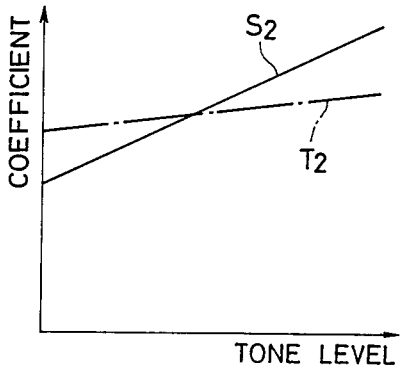

FIGS. 7 and 8 are graphs showing the conversion characteristics of the first and second coefficient data memories, respectively.

Figure 9:
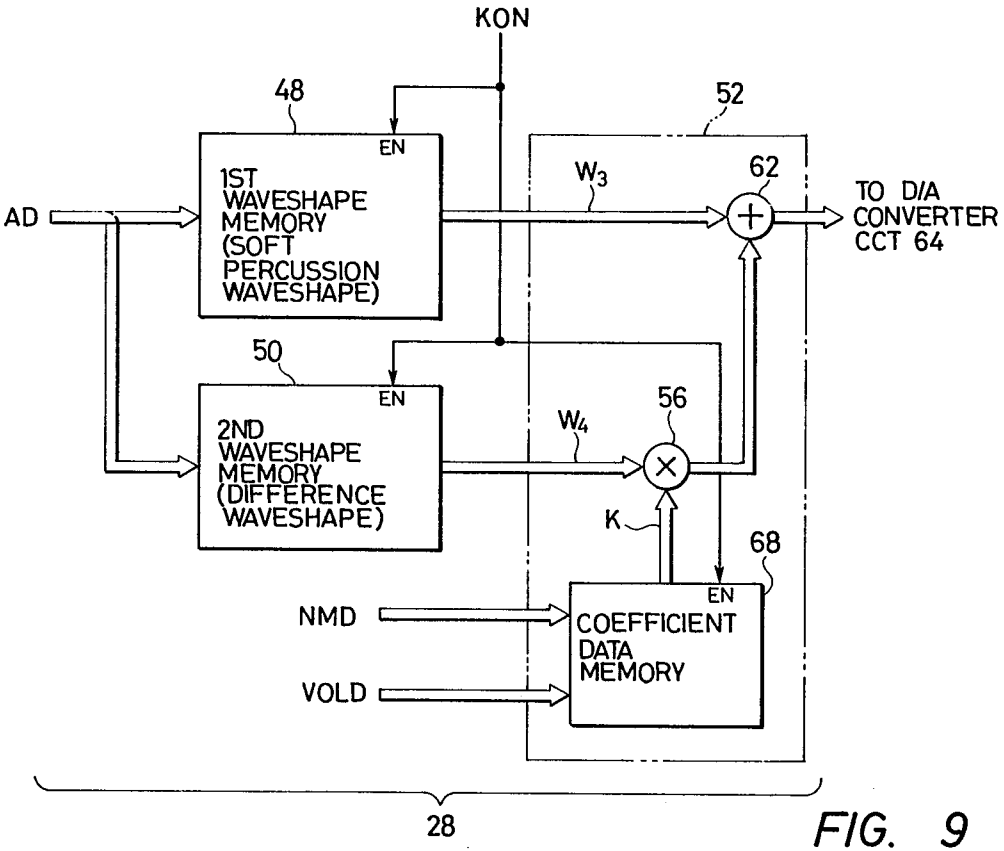

FIG. 9 is a circuit diagram showing an example of modification of the rhythm tone generating unit.

Figure 10:
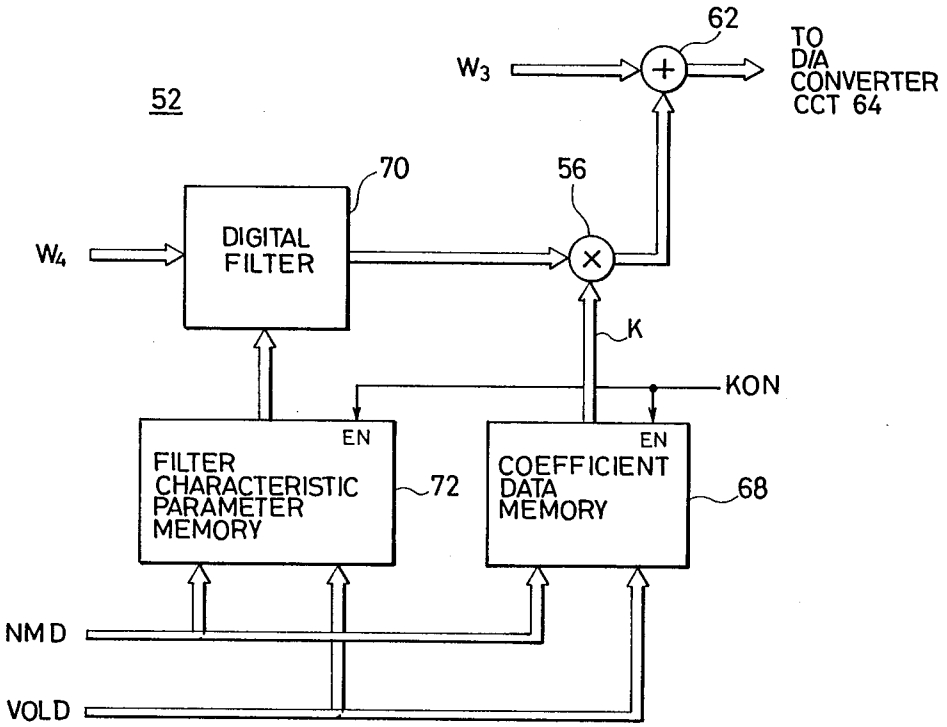

FIG. 10 is a circuit diagram showing an example of modification of the adding synthesis unit.

Like parts are assigned with like reference numerals and symbols throughout the drawings for the sake of simplicity.

DETAILED DESCRIPTION OF THE PREFERRED EMBODIMENTS

Figure 1:
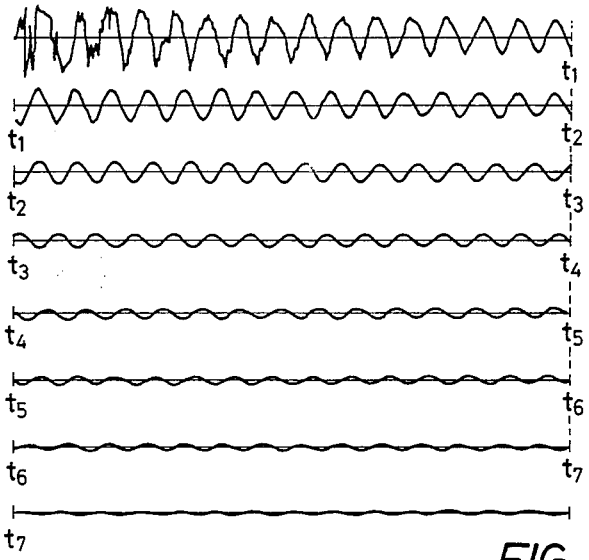
FIGS. 1 and 2 are waveshape diagrams showing a hard percussion tone waveshape and a soft percussion tone waveshape of a "tam-tam" drum.
Figure 2:
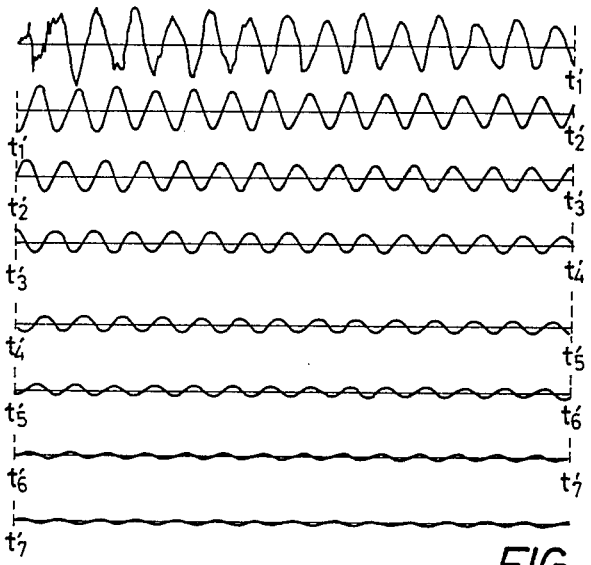
Figure 3:
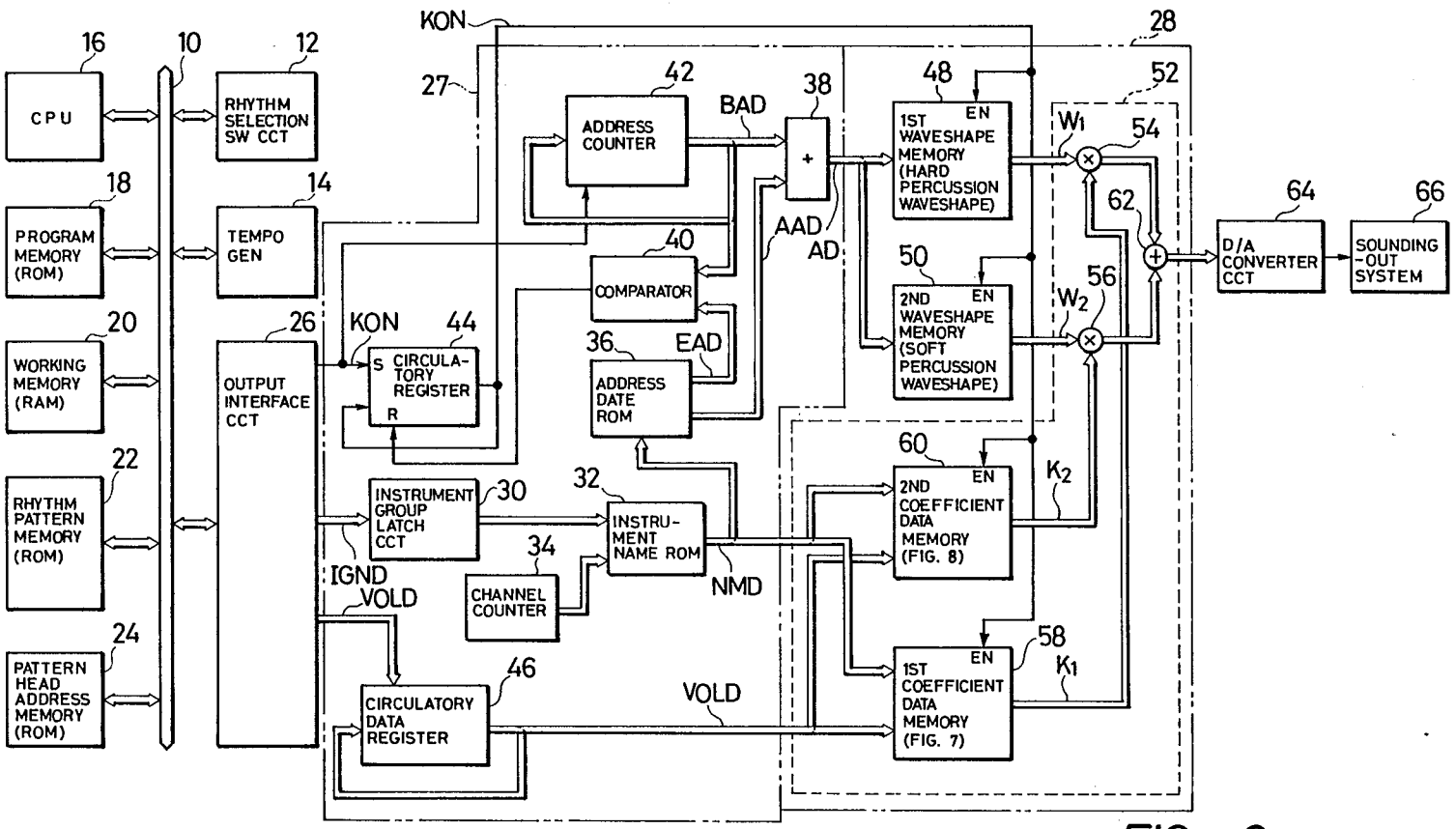
FIG. 3 is a block diagram showing the circuit arrangement of the automatic rhythm tone generating apparatus representing an embodiment of the present invention.

FIG. 3 shows an example of circuit arrangement of the automatic rhythm apparatus representing an embodiment of the present invention. This automatic rhythm apparatus is so designed that the generation of rhythm tones is controlled by the aid of a microcomputer to constitute a rhythm pattern performance.

BUS-RELATED CIRCUITRY

To a bus 10 are operatively connected a rhythm selection switch circuit 12, a tempo generator 14, a central processing unit (CPU) 16, a program memory 18, a working memory 20, a rhythm pattern memory 22, a pattern head address memory 24 and an output interface circuit 26.

The rhythm selection switch 12 includes a number of rhythm selection switches corresponding to numerous kinds of rhythms such as march, waltz and swing, respectively, and is designed so that a desired rhythm such as "march" can be selected by a selective operation of these switches.

The tempo generator 14 is intended to generate a tempo clock signal in accordance with a tempo which is set by a conventional tempo control not shown.

The CPU 16 is intended to carry out various kinds of processing aimed to generate rhythm tones to construct patterned rhythm performance in accordance with the program stored in the program memory 18 which is comprised of a ROM (Read-Only Memory).

The working memory 20 is comprised of a RAM (Random Access Memory), and includes those parts which function as registers, counters and so forth for the generation of rhythm tones, as described in the following items (1) to (4).

(1) Rhythm register RHYREG

This register is intended to store rhythm data indicative of a specific rhythm (rhythm genre) selected by the abovesaid rhythm selection switch.

(2) Pattern head address register HADREG

This register is intended to store the pattern head address data read out from the pattern head address memory 24.

(3) Tempo counter TMPCNT

This counter is intended to count the tempo clock signals delivered from the tempo generator 14. In case of, for example, a quadruple meter (4-beat), it assumes a count value ranging from 0 to 47 for one bar (measure), and is reset at the arrival of the timing at which the count becomes "48".

(4) Event data register EVTREG

This register is intended to store the event data read out from the rhythm pattern memory 22.

The rhythm pattern memory 22 is comprised of a ROM, and stores a rhythm pattern data for each rhythm genre such as march, waltz and so forth as shown exemplarily in FIG. 4. In this case, each rhythm pattern data is of a format which, as shown typically with respect to "march" in FIG. 4, is of the arrangement that a data IGN indicating the instrument group number is disposed at the head, that event data EVT are disposed for an appropriate plurality of bars in the order of pronunciation, and that a return data RTN is disposed at the end of these data. Also, each event data EVT is comprised of, for example, a two-byte data, and is so arranged that the upper bits of the first byte indicates a channel number CHN, and the lower bits of the first byte indicates a sounding-out timing TMG, and the second byte denotes the tone volume (intensity) level VOL, respectively.

Here, the instrument group number IGN is preliminarily set for each rhythm, and the correspondency therebetween is shown exemplarily as below.

| Rhythm | IGN |
|---|---|
| March | 0 |
| Waltz | 1 |
| Swing | 2 |
| Latin rock | 3 |
| Bounce | 4 |
| Bossanova | 5 |
| Samba | 6 |
| Latin | 7 |

Also, the channel number CHN indicates either one of the numbers assigned to, for example, eight time-division channels. Assignment of which percussion instrument to which one of the channels has been preliminarily set for each rhythm. The correspondency therebetween in such an assignment will be exemplarily shown as follows with respect to the instrument group number IGN=0 in case of the rhythm being "march", and also with respect to the case wherein the instrument group number IGN=7, with the rhythm being "Latin".

| CHN | March | Latin |
|---|---|---|
| 0 | Top cymbal | Claves |
| 1 | High hat cymbal | Maracas |
| 2 | Snare drum<br>Brush shot | Timbales |
| 3 | Light snare drum | Bongo |
| 4 | Light bass drum | Conga |
| 5 | Castanet | Guiro |
| 6 | Pedal high hat | Cowbell |
| 7 | Heavy snare drum | Floor tom-tom |

It should be noted here that the sounding-out timings TMG are to be indicated by numeral values from among 0~47 in correspondence to count values of the abovesaid tempo counter TMP.

Accordingly, the rhythm pattern data corresponding to each specific rhythm contains information identifying the specific instrument group including those eight percussion instruments necessary for and predetermined for the performance of such a rhythm, and also contains information indicative of which ones of these percussion instruments are to be sounded out at which timings and with which tone volumes.

The pattern head address memory 24 is comprised of a ROM, and stores pattern head addresses indicative of the head addresses (locations of respective IGN data) of the rhythm pattern data for the respective rhythm.

The output interface circuit 26 is intended to output a tone command signal including a key-on signal KON, an instrument group number data IGND and a tone volume designating data VOLD. This circuit is arranged so that, with respect to both the key-on signal KON and the tone volume data VOLD, they are delivered out after assigning these respective data to a specific time-division channel which is designated by the channel number CHN.

RHYTHM PATTERN READING-OUT OPERATION

When a desired rhythm is selected by operating the rhythm selection switch, a rhythm data indicating this selected rhythm genre is stored in the rhythm register RHYREG contained in the working memory 20. And, a pattern head address data corresponding to this selected rhythm is read out from the pattern head address memory 24 in accordance with the contents of this rhythm register RHYREG, and it is transmitted to the pattern head address register HADREG contained in said working memory 20.

Then, in accordance with the contents of the pattern head address register HADREG, the head data of the stored rhythm pattern for the selected rhythm genre, i.e. the data indicative of the instrument group number IGN, is read out from the rhythm pattern memory 22 and in response thereto, the output interface circuit 26 delivers out an instrument group number data IGND.

Accordingly, there is obtained, as the instrument group number data IGND, a data indicative of the instrument group number IGN (which will be "0" if the selected rhythm is "march") corresponding to the selected rhythm.

Thereafter, when the rhythm start switch not shown is turned on, an initial event data EVT (the data located next to the head data) is read out from the rhythm pattern memory 22, and it is stored in the event data register EVTREG contained in the working memory 20. And, from this latter register EVTREG, there is extracted a data indicative of the sounding-out-timing TMG, and judgment is made as to whether or not the sounding-out timing TMG coincides the count value of the tempo counter TMPCNT. If the result of this judgment indicates non-coincidence, this means that the timing for sounding-out has not arrived yet, so that the data contained in the event data register EVTREG is still preserved therein.

On the other hand, in case the judgment indicates coincidence, this means the arrival of the sounding-out timing. Therefore, the data indicative of the channel number CHN and the data indicative of the tone volume level VOL which are both contained in the event data register EVTREG are transmitted to the output interface circuit 26. And, in the output interface circuit 26, a key-on signal KON indicative of the time for tone sounding is assigned to a specific time-division channel designated by the channel number CHN, and along with this a tone volume designating data VOLD indicative of the tone level (volume) is assigned to the same time-division channel as the above-mentioned channel, and both the key-on timing signal KON and a tone volume designating data VOLD are delivered out in synchronism with each other, from the output interface circuit 26.

Thereafter, a next event data EVT is read out from the rhythm pattern memory 22 to be delivered to the event data register EVTREG, and judgment is made whether or not there is a coincidence of timing in a manner as described just above. And, if the result of this judgment indicates coincidence of timing, the output interface circuit 26 is operated in a same manner as that described above to assign both the key-on signal KON and the tone volume designating data VOLD to a designated time-division channel, and they are delivered out in mutual synchronism from the output interface circuit 26.

Such an output operation as described above continues in a manner similar to that mentioned above until an event data indicative of non-coincidence of timing is read out and delivered to the event data register EVTREG. In other words, such a channel assignment as mentioned above can be carried out up to a maximum of eight channels for a same sounding-out timing, so that it is possible to sound out percussion tones of a maximum of eight percussion instruments simultaneously for each selected rhythm.

In case an event data EVT representing non-coincidence of timing is read out and delivered to the event data register EVTREG, the processing awaits until the count value increases till it coincides the sounding-out timing TMG of said event data. When there is thus established a coincidence therebetween, an output delivering operation similar to that described above is carried out.

By reading out rhythm patterns from the rhythm pattern memory 22 in timewise serial fashion, there will be realized a performance of, for example, "march" rhythm consecutively for a plurality of bars. And, becuase a return data RTN is affixed to the end of said rhythm pattern data as shown in FIG. 4, it will be noted that, when this return data RTN is detected, the whole reading-out operation is carried out over again, starting with the head of the initial bar after coming back thereto at each detection of the return data RTN, and thus it is possible to realize a continued rhythm performance.

READING-OUT CONTROL UNIT

A reading-out control unit 27 is intended to control the time-divisional reading-out of the data from various memories contained in the rhythm tone generating unit 28, based on the instrument group number data IGND, the key-on signal KON and the tone volume designating data VOLD delivered from the output interface circuit 26.

The instrument group number data IGND is latched by an instrument group latching circuit 30, and it is delivered out to an instrument name ROM 32. The instrument name ROM 32 stores instrument name data representing, respectively, the eight percussion instruments for each rhythm, i,e. for each instrument group, and is arranged to function so that the instrument name data for eight instruments belonging to a specific instrument group is designated, for being read out, by the instrument group number data IGND.

The reading-out operation by the instrument name ROM 32 is controlled in accordance with the count output of a channel counter 34 which counts pulses synchronous with the channel timing. More particularly, instrument name data for eight instruments are read out successively in correspondence to the count values 0, 1, 2, . . . , 7 of the counter 34. Such a reading-out operation is repeated at every counting cycle of the counter 34. For example, in case the instrument group number data IGND indicates 0" ("march" is selected as the desired rhythm), there are read out, successively, and repetitively from the instrument name ROM 32, those instrument name data for eight instruments representing, respectively, "top cymbal", "high hat cymbal", . . . , "heavy snare drum".

The instrument name data NMD read out from the instrument name ROM 32 are supplied to the rhythm tone generating unit 28 and also to an address data ROM 36. The address data ROM 36 stores both the start address data and the end address data intended for reading out the hereinafter described percussion tone waveshape for each instrument name with respect to, for example, twenty-eight kinds of percussion instruments which are employed for the performance of the previously stated eight kinds (genres) of rhythms. And, this address data ROM 36 is designated so that the start address data and the end address data corresponding to the instrument name which may be, for example, "top cymbal" designated by the instrument name data NMD are read out. The start address data which is read out from the address data ROM 36 is supplied to an adder 38 as an upper address data AAD. Also, the end address data EAD is supplied to a comparator 40 as one of the comparative inputs.

An address counter 42 possesses eight time-division channels, and is arranged to be operative so that at the end of one circulation of data for each channel, its count value is upped by "one". More particularly, at the arrival of a key-on signal KON which is assigned to a specific time-division channel, this counter 42 commences a counting operation concerning the corresponding channel, and subsequently at each end of one circulation of the eight data, the count value of this counter is upped by "one". This operation mode applies equally to other time-division channels. Accordingly, the counter 42 is capable of delivering out, time-divisionally, count outputs for eight channels. The count output of the counter 42 is supplied to the comparator 40 as the other of the comparative inputs, and also it is supplied to the adder 38 as a lower address data BAD.

The adder 38 is intended to combine an upper address data AAD (as upper bits) and a lower address data BAD (as lower bits) for each channel, and to deliver out an address data AD for use in reading out a concerned percussion tone waveshape. The address data AD is supplied to the rhythm tone generating unit 28, and it is used to time-divisionally read out the percussion tone waveshapes for the eight channels (eight instruments).

A circulatory register 44 is comprised of a shift register of 8-stages/1-bit, and is designed to write-in a key-on signal KON as a setting input S at a timing correponding to the specific channel to which this signal has been assigned, and to store this signal in a circulatory fashion. The key-on signal KON which is derived from the circulatory register 44 is supplied to the rhythm tone generating unit 28 to be used to enable the operation of reading-out from the respective memories.

The comparator 40 is intended to compare the count output of the counter 42, with the end address data EAD, and is operative so that, upon coincidence of the lower address value with the end address value, it generates a coincidence output. The generation of this coincidence output signifies that the reading-out of the percussion tone waveshape has ended. The coincidence output delivered from the comparator 40 is supplied to the circulatory register 44, and it serves to reset the specific channel for which the reading-out of the waveshape has ended.

A circulatory data register 46 is comprised of a shift register of, for example, 8-stages/m-bits ("m" denotes the number of bits of the volume designating data VOLD), and it is arranged to be operative so that it writes-in the tone volume designating data VOLD at a timing corresponding to the channel to which this data has been assigned, and to store this data in a circulatory fashion. The tone volume designating data VOLD which is derived from the circulatory data register 46 is supplied to the rhythm tone generating unit 28 to be used for controlling the mixing ratio of the read-out waveshapes.

It should be noted here that the channel counter 34, the address counter 42 and the registers 44 and 46 are designed to be operative in synchronism with each other for each channel, and that the rhythm tone generating unit 28 are supplied with an instrument name data NMD, an address data AD, a key-on signal KON and a tone volume designating data VOLD in synchronism relative to each other for each channel.

RHYTHM TONE GENERATING UNIT

The rhythm tone generating unit 28 includes a first waveshape memory 48, a second waveshape memory 50 and an adding synthesis unit 52.

As described above, in case twenty-eight kinds of percussion instruments are used for the performance of eight rhythms, there are stored those percussion tone waveshapes corresponding respectively to twenty-eight kinds of percussion instruments in each of the first and second waveshape memories 48 and 50. In such a case, the waveshape of a hard percussion (strong strike) is stored in the first waveshape memory 48 for each percussion instrument, and a soft percussion (weak strike) waveshape is stored in the second waveshape memory 50 for each instrument. In storing the waveshapes for each percussion instrument, an actual percussion instrument such as high hat cymbal is struck hard and soft respectively to pickup percussion tone signals of the respective strikes, and the whole waveshape ranging from attack to decay of each this percussion tone signal is appropriately samples and subjected to A/D conversion, whereby digital waveshape data indicative of the amplitude values at respective sampling points of a train of plural cycles of a waveshape are stored in either the waveshape memory 48 and 50 depending on the intensity of the percussion.

Also, in performing such a storing of waveshapes, it is desirable to carry out the below-mentioned phase-matching processing steps in order to enable the subsequently-described mixing of waveshapes to be conducted smoothly.

STEP (1)

A desired natural percussion instrument is softly struck, and an original waveshape A for a plurality of cycles ranging from the commencement of pronunciation till the end of pronunciation as illustrated in FIG. 5A is obtained. Also, the same natural percussion instrument is struck hard, and likewise an original waveshape B as shown in FIG. 5B is obtained.

STEP (2)

The phase of the original waveshapes A and B which have been prepared as above are processed so as to modify these phases in such a way as to mitigate the phase difference present therebetween. This phase processing (modification) can be accomplished on an equivalence basis in such a manner as shown in, for example, the below-mentioned Steps (2a)~(2c) that the original waveshape which is one of the two original waveshapes is subjected to a filtering operation to procure a waveshape closely resembling the other original waveshape A.

STEP (2a)

The whole waveshape lengths of these two original waveshapes A and B are divided respectively into a plurality of frames (timewise framing), and spectrum analysis of these two waveshapes is conducted per frame. This framing is not limited to mere equal time intervals, but appropriate intervals may be adopted to suit the characteristics of waveshape variations. In the example illustrated, the whole waveshape length is divided into seven frames ranging from 0 to 6. An example of the result of spectrum analysis with respect to a given frame is illustrated, in which the original waveshape A is as shown in FIG. 6A, while the original waveshape B is as depicted in FIG. 6B.

STEP (2b)

With respect to the spectrum obtained in Step (2a), deviation is sought for each frame. for example, the spectrum deviation between FIG. 6A and FIG. 6B is as shown in FIG. 6C.

STEP (2c)

Based on the spectrum deviation for each frame which has been obtained in Step (2b), filtering characteristic pattern for each frame is sought. In accordance with these filtering characteristic parameters thus obtained, filtering operation is carried out, for each frame, for the original waveshape B corresponding to the hard percussion. By virtue of these filtering operations, there can be obtained a waveshape closely resembling the original waveshape A which corresponds to a soft percussion.

Subsequent to the above-described Step (2c), the original waveshape B corresponding to the hard percussion which has been made the object of filtering operation is subjected to A/D conversion, and the result is stored in the first waveshape memory 48, while the waveshape corresponding to the soft percussion (i.e. the waveshape closely resembling the original waveshape A) is A/D-converted and it is stored in the second waveshape memory 50. The waveshape which has thus been stored in the second waveshape memory 50 closely resembles the original waveshape A in view of shape. However, since this waveshape is one that is obtained by filtering the original waveshape B, its phase is substantially in agreement with the phase of the original waveshape B.

As another example of phase modifying operation in the abovesaid Step (2), there may be adopted the manner shown in the below-mentioned Step (2').

STEP (2')

By shifting for an appropriate amount the phase of either one or both of the original waveshape A and B for each predetermined phase sector (wave section), there is performed a phase modification in such a way that the phases of these two waveshapes A and B in their respective phase sectors are brought toward each other to coincide each other. The resulting original waveshapes A and B which have thus been modified of their phases are A/D-converted and stored in the waveshape memories 50 and 48, respectively.

To the first and second waveshape memories 48 and 50 is supplied the abovesaid key-on signal KON to serve as an enabling signal EN, and also the abovesaid address data AD as an address input. As a result, from the waveshape memory 48 is read out time-divisionally a waveshape data $W_1$ corresponding to the hard percussion, while a waveshape data $W_2$ corresponding to the soft percussion is read out time-divisionally from the waveshape memory 50. In this case, let us here take up a certain channel to which a tone command has been applied, and it will be noted that, with respect to that specific percussion instrument which has been assigned to said channel, there are read out a waveshape data corresponding to the hard percussion and a waveshape data corresponding to the soft percussion from the waveshape memories 48 and 50, respectively.

In the adding synthesis unit 52, there are provided multipliers 54 and 56, first and second coefficient data memories 58 and 60, and an adder 62.

The coefficient memories 58 and 60 respectively store coefficient data indicative of the coefficients corresponding to various tone levels (volumes) for each instrument name. FIGS. 7 and 8 exemplarily show the conversion characteristics of the coefficient data memories 58 and 60, respectively. The rectilinear lines $T_1$ and $T_2$ show the relationship between the tone level and the coefficient magnitude with respect to the "tam-tam" drum, and the rectilinear lines $S_1$ and $S_2$ show the relationship between the tone level and the coefficient magnitude with respect to the "cymbals". In these examples, it will be noted that the coefficient is greater with the coefficient data memory 60 for lower tone levels, and that a greater coefficient is noted for the coefficient data memory 58 with respect to higher tone levels.

For each channel, the coefficient data memories 58 and 60 are supplied with the abovesaid key-on signal KON to serve as an enable signal EN, and also with an address input which consists of the abovesaid instrument name data NMD and tone volume designating data VOLD. As a result, for the respective channels, both coefficient data $K_1$ and $K_2$ complying to the respective tone levels indicated by the respective tone volume designating data VOLD are time-divisionally read out from the coefficient data memories 58 and 60. In this case, let us pay our attention to a certain channel which is applied with a tone producing command. It will be noted that a pair of coefficient data complying to such mutually different conversion characteristics as shown in FIGS. 7 and 8 with respect to the percussion instrument assigned to said channel are read out in parallel fashion from the coefficient data memories 58 and 60.

The waveshape data $W_1$ corresponding to the hard percussion which is read out from the waveshape memory 48 is multiplied in a multiplier 54 with the coefficient data $K_1$ delivered from the coefficient data memory 58. Also, that waveshape data $W_2$ corresponding to the soft percussion which is read out from the waveshape data memory 50 is multiplied in a multiplier 56 with the coefficient data $K_2$ delivered from the coefficient data memory 60.

An adder 62 is intended to add the multiplication output from the multiplier 54 and the multiplication output from the multiplier 56. By virtue of this addition, it becomes possible to mix the hard percussion waveshape and the soft percussion waveshape for each percussion instrument. In this case, the waveshape mixing ratio is determined by the coefficient data $K_1$ and $K_2$. The addition output of the adder 62 is converted to an analog signal by a D/A converter circuit 64. And, the analog signal delivered from the D/A converter circuit 64 is supplied to a sound system including a power amplifier, a loudspeaker, etc. to be converted to a sound. Thus, a sound for an automatic rhythm performance is outputted from the sound system as each tone in the rhythm pattern.

As described above, the waveshape corresponding to a hard percussion and the waveshape corresponding to a soft percussion, after having been phase-matched, are stored in the waveshape memories 48 and 50, respectively. Therefore, it becomes possible to combine these two waveshapes without trouble and inconvenience (i.e. without developing, for example, "beat" phenomenon due to fluctuations in phase) when these two kinds of waveshapes are weightedly added together to synthesize a waveshape in an intermediate volume by the adding synthesis unit 52.

FIG. 9 shows an example of modification of the rhythm tone generating unit 28. The first waveshape memory 48 stores the waveshape, for each instrument name, which corresponds to a soft percussion among the original waveshapes which have been phase-modified (adjusted) in such a manner as that described in Step (2) or (2'). In this instant embodiment, however, the below-mentioned further Step (3) is added next to the above-mentioned Step (2) or (2').

STEP (3)

The phase-modified original waveshape which have been obtained as a result of the phase-modifying processing in Step (2) or (2') are A/D-converted, respectively, and the difference between the two is obtained at every sampling point, and as a result, a waveshape representing the difference between the phase-modified two waveshape is obtained.

The resulting difference waveshape thus obtained in Step (3) is stored in the waveshape memory 50 for each instrument name.

In the adding synthesis unit 52, a coefficient data memory 68 stores coefficient data indicative of coefficients corresponding to various tone levels for each instrument name. From this coefficient data memory 68 are time-divisionally read out for the respective channels, in a manner similar to that described with respect to the abovesaid memory 58, key-on signals KON, instrument name datas NMD and coefficient datas K in accordance with the respective tone volume designating data VOLD. The conversion characteristic of the coefficient data memory 68 can be appropriately determined in such a form resembling that which is shown, for example, in FIG. 7.

The difference waveshape data $W_4$ which is read out from the waveshape memory 50 is multiplied in the multiplier 56 with the coefficient data K supplied from the coefficient data memory 68. And, the multiplication output delivered from the multiplier 56 is added by the adder 62 to the waveshape data $W_3$ which corresponds to the soft percussion and which is delivered from the waveshape memory 48.

As a result of addition by the adder 62, there is obtained a waveshape data indicative of the mixed waveshape which is a mixture of the waveshape corresponding to the hard percussion and the waveshape corresponding to the soft percussion. This waveshape is supplied to the D/A converter circuit 64. The waveshape mixing ratio in this instance is determined by the coefficient data K.

Now, the difference waveshape which is stored in the waveshape memory 50 represents the difference between the waveshape corresponding to the hard percussion and the waveshape corresponding to the soft percussion at each sampling point. Therefore, this difference waveshape which is full of high harmonic components presents a (spiny) shape. If such a spiny difference waveshape is added, even at a small level, to the waveshape corresponding to a soft percussion, there will arise the fear that the resulting synthesized waveshape gives an impression representing an abrupt change in shape from that waveshape corresponding to the soft percussion which is read out from the waveshape memory 48. And, further, there is the fear that said waveshape also differs from the waveshape of the actual performance tone of a natural percussion instrument. Therefore, it is desirable to change the adding synthesis unit 52 to such a design as mentioned in FIG. 10, and to provide a digital filter (low-pass filter) 70 on the output side of the second waveshape memory 50, and to read out from a filtering characteristic parameter memory 72 a filtering characteristic parameter corresponding to the tone level, in accordance with the instrument name data NMD and the tone volume designating data VOLD, whereby to control the digital filter 70. This control of the filter serves so that more roundish difference waveshapes are outputted from the digital filter 70 for lower tone levels, and that less roundish difference waveshapes (difference waveshapes close to the innate difference waveshape which is outputted from the waveshape memory 50) are outputted from the digital filter 70 for higher tone levels. By virtue of such filter control as that described just above, it becomes possible to make the difference waveshape which is added to the waveshape corresponding to a soft percussion (i.e. output of the memory 48) in case of a relatively low tone level a smooth-shaped one having much less high harmonic components, and thus such inconvenience and trouble as mentioned above can be eliminated.

It should be noted here that arrangement may be provided so that a waveshape corresponding to a hard percussion is stored in the first waveshape memory 48, and that the adder 62 is replaced by a subtractor.

In the above-described embodiment, the first and second waveshape memories 48 and 50 are designed that they store the whole waveshapes of percussion tones each ranging from the commencement till the end of decay of each percussion tone. It should be noted here that these waveshape memories may not have such an arrangement, but that they may be designed so that they store the waveshapes of the attack portion and also a part of the subsequent waveshape. In such a case, the address data generating circuit is arranged to be operative so that, after the general waveshape of the attack portion has been read out, a portion of its subsequent waveshape (this also is a waveshape in a plurality of cycles) is read out repetitively, to thereby be able to obtain the entire waveshape ranging from the commencement through to the end of pronunciation of a tone. The amplitude envelope of the waveshape signal thus obtained can be imparted by an appropriate envelope imparting means.

Also, in case the waveshape corresponding to a hard percussion and the waveshape corresponding to a soft percussion are to be stored in the first and second waveshape memories 48 and 50, respectively, there may be provided an arrangement that, in place of storing the sampling data of the amplitudes of a percussion tone waveshape as they are, the increment data which represent differences between the amplitudes at adjacent sampling points are stored and these increment amplitude data are cumulatively added or subtracted as these data are read out to thereby obtain innate amplitude sampling data.

Furthermore, in the above-described embodiment, arrangement is provided so that the tone volume designating signal is stored, for being read out later, in the rhythm pattern memory 22 for the purpose of controlling the waveshape mixing ratio. It should be noted, however, that the tone volume designating signal generating means is not limited to such an arrangement, but that the tone volume designating signal generating means may be of such a type that, for example, which utilizes rhythm pattern pulses, or which utilizes the tone volume control disposed on the panel surface of the apparatus.

What is claimed is:

1. An automatic rhythm apparatus, comprising:

first waveshape memory means for storing first wave data corresponding to a first waveshape for a train of plural cycles of a first percussion tone produced from a given percussion instrument when struck with a first strength of percussion;

second waveshape memory means provided in parallel with said first waveshape memory means for storing second wave data corresponding to a second waveshape for a train of plural cycles of a second percussion tone produced from said percussion instrument when struck with a second strength of percussion different from said first strength;

tone command signal generating means for generating tone command signals according to a rhythmic pattern and designating timings and volumes of tones to be produced;

reading-out means connected to said first and second waveshape memory means and to said tone command signal generating means for reading out said first and second wave data from said first and second waveshape memory means at timings designated by said tone command signals;

mixing means connected to said first and second waveshape memory means for mixing said first and second wave data as said data are read out from said first and second waveshape memory means, respectively, to provide an output; and control means connected to said first and second waveshape memory means and to said tone command signal generating means for determining a ratio of mixing said read-out first and second wave data in accordance with the tone volume designated by said tone command signal.

2. An automatic rhythm apparatus according to claim 1, in which:

said control means includes a first coefficient data memory means connected to said first waveshape memory means and to said tone command signal generating means for storing first coefficient data indicative of mixing coefficients for the first waveshape data being read out from said first waveshape memory means with respect to various tone volumes and a second coefficient data memory means connected to said second waveshape memory means and to said tone command signal generating means for storing second coefficient data indicative of mixing coefficients for the second waveshape data being read out from said second waveshape memory means with respect to various tone volumes;

said first coefficient data memory means storing mixing coefficients greater than those stored in said second coefficient data memory means in range of higher tone volume levels and storing mixing coefficients smaller than those stored in said second coefficient data memory means in range of lower tone volume levels.

3. An automatic rhythm apparatus according to claim 1, in which:

said first and second waveshape memory means store said first and second data, wherein the phases of said first and second waveshapes are matched with respect to to each other.

4. An automatic rhythm apparatus according to claim 3, in which:

either one of said first and second waveshapes is a waveshape obtained by filtering the waveshape of the corresponding percussion tone from said given percussion instrument to thereby obtain a waveshape whose phase is matched with the phase of the other waveshape.

5. An automatic rhythm apparatus according to claim 3, in which:

said phase-matched waveshapes correspond to waveshapes obtained by dividing said first and second waveshapes into a plurality of phase frames, and by shifting, in each of said phase frames, at least one of said first and second waveshapes relative to each other to achieve substantial coincidence in phase between these two waveshapes.

6. An automatic rhythm apparatus, comprising:

first waveshape memory means for storing first wave data corresponding to a first waveshape for a train of plural cycles of a first percussion tone being produced from a given percussion instrument when struck with a first strength of percussion;

second waveshape memory means for storing second wave data corresponding to the difference between said first waveshape and a waveshape of a second percussion tone produced from said percussion instrument when struck with a second strength of percussion different from said first strength of percussion;

tone command signal generating means for generating tone command signals according to a rhythmic pattern and designating timings and volumes of tones to be produced;

reading-out means connected to said first and second waveshape memory means and to said tone command signal generating means for reading out said first and second wave data from said first and second waveshape memory means at timings designated by said tone command signals;

mixing means connected to said first and second waveshape memory means for mixing said first and second wave data read out from said first and second waveshape memory means, respectively, to provide an output; and control means connected to said first and second waveshape memory means and to said tone command signal generating means for determining a ratio of mixing said read-out first and second wave data in accordance with the tone volume designated by said tone command signal.

7. An automatic rhythm apparatus according to claim 6, in which:

said control means includes coefficient data memory means connected to said second waveshape memory means and to said tone command signal generating means for storing coefficient data indicative of mixing coefficients for said second waveshape to be mixed with said first waveshape with respect to various tone volumes.

8. An automatic rhythm apparatus according to claim 7, in which:

said control means further comprises digital filtering means connected to an output side of said second waveshape memory means, and filtering characteristic parameter memory means connected to an input side of said digital filtering means and to said tone command signal generating means for reading out, from said filtering characteristic parameter memory means, a filtering characteristic parameter complying to said first waveshape and also to its tone volume level, to thereby control said digital filtering means.

9. An automatic rhythm apparatus, comprising:

first and second waveshape memory means storing first and second waveshapes, respectively, wherein the first waveshape corresponds to plural cycles of the tone produced by a percussion instrument when struck with a first strength and the second waveshape corresponds to plural cycles of the tone produced by said percussion instrument when struck with a second strength which is different from the first strength;

tone command signal generating means for generating tone command signals designating the timings and volumes of different tones to be produced;

reading-out means connected to said first and second waveshape memory means and to said tone command signal generating means for reading out the first and second waveshapes in parallel fashion at timings designated by the tone command signals; and mixing means for mixing the first and second waveshapes in accordance with the volume designated by the tone command signal for each tone, thereby to provide different output waveshapes corresponding to different volumes.

10. An automatic rhythm apparatus, comprising:

first and second waveshape memory means storing first and second waveshapes, respectively, wherein the first waveshape corresponds to plural cycles of the tone produced by a percussion instrument when struck with a first strength and the second waveshape corresponds to plural cycles of the difference between the first waveshape and the waveshape of the tone produced by said percussion instrument when struck with a second strength which is different from the first strength;

tone command signal generating means for generating tone command signals designating the timings and volumes of different tones to be produced;

reading-out means connected to said first and second waveshape memory means and to said tone command signal generating means for reading out the first and second waveshapes in parallel fashion at timings designated by the tone command signals; and mixing means for mixing the first and second waveshapes in accordance with the volume designated by the tone command signal for each tone, thereby to provide different output waveshapes corresponding to different volumes.

* * * * *